United States Patent [19]

Mantegani

[11] 4,142,368

[45] Mar. 6, 1979

[54] HYDRAULIC SYSTEM FOR SUPPLYING HYDRAULIC FLUID TO A HYDRAULICALLY OPERATED DEVICE ALTERNATELY AT PRESSURES OF DIFFERENT VALUE

[75] Inventor: Enzo Mantegani, Milan, Italy

[73] Assignee: Welko Industriale S.p.A., Milan, Italy

[21] Appl. No.: 841,726

[22] Filed: Oct. 12, 1977

[30] Foreign Application Priority Data

Oct. 28, 1976 [IT] Italy ..... 28786 A/76

[51] Int. Cl.[2] ..... F15B 1/02; F15B 3/00

[52] U.S. Cl. ..... 60/413; 60/416; 91/420

[58] Field of Search ..... 60/371, 375, 413, 416, 60/419; 91/275, 459, 461, 420

[56] References Cited

U.S. PATENT DOCUMENTS

| | | | |
|---|---|---|---|
| 2,839,895 | 6/1958 | Hemeon | 60/371 |
| 3,779,017 | 12/1973 | Fujisawa et al. | 60/413 |
| 3,986,437 | 10/1976 | Lioux | 91/420 |

*Primary Examiner*—Edgar W. Geoghegan
*Attorney, Agent, or Firm*—Michael J. Striker

[57] ABSTRACT

A hydraulic system for supplying hydraulic fluid to a hydraulically operated device alternately at pressures of different values, said system comprising a first hydraulic circuit arranged to be supplied with hydraulic fluid at a low pressure by a pump and for supplying the hydraulic device with fluid at said low pressure through a pilot operated valve, a second hydraulic circuit provided with a pressure multiplier piston device which produces hydraulic fluid at a pressure greater than that of the low pressure fluid and having a first chamber connected to the first hydraulic circuit and a second chamber of smaller area than the first chamber connected to the second hydraulic circuit, the second hydraulic circuit being provided with a pressure accumulator for maintaining high pressure in the second hydraulic circuit and said second hydraulic circuit being provided with a second pilot operated valve for supplying the hydraulic device with fluid at said high pressure.

5 Claims, 1 Drawing Figure

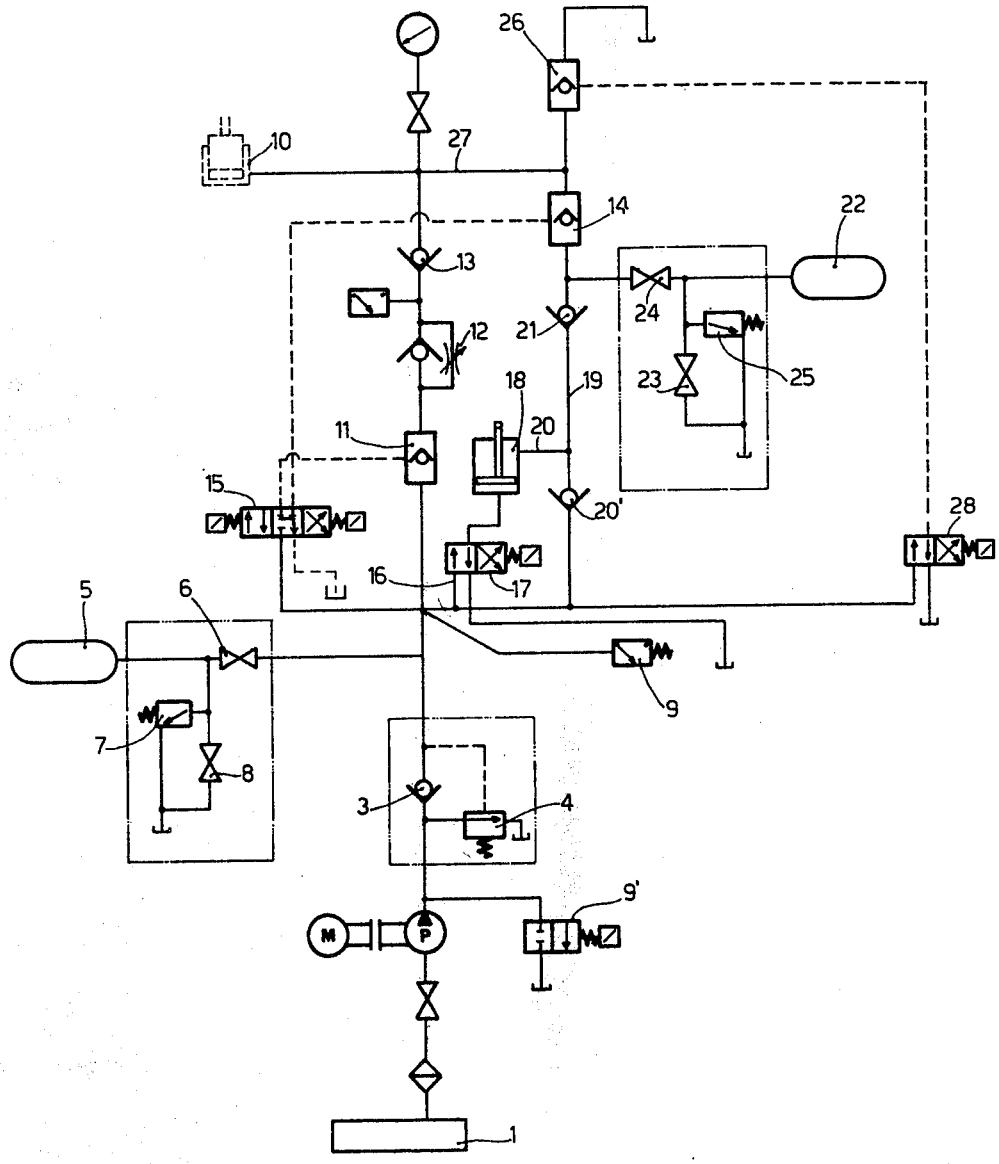
26
10
27
14
22
13
24
12
21
25
23
18
19
11
20
15
20'
28
16
17
5
6
9
7
8
3
4
9'
M
P
1

HYDRAULIC SYSTEM FOR SUPPLYING HYDRAULIC FLUID TO A HYDRAULICALLY OPERATED DEVICE ALTERNATELY AT PRESSURES OF DIFFERENT VALUE

BACKGROUND OF THE INVENTION

This invention relates to a hydraulic system for supplying hydraulic fluid to a hydraulically operated device alternately at pressures of different values, and to a hydraulically operated device provided with such a system.

It is known to feed a liquid under pressure to a hydraulically operated device or utilizer, such as a hydraulic piston and cylinder device able to provide a mechanical force, alternately at two different pressures and particularly at a relatively low pressure and a relatively high pressure.

It is also known that in many devices, the feeding of the pressure must be as sudden as possible to achieve particular effects. As for example in a hydraulic press for manufacturing ceramic or refractory tiles, of the kind wherein the member exerting the pressing force is a hydraulic piston and cylinder, and wherein the pressing of the tiles occurs in a cycle comprising at least a first pressing step at a low pressure and a second pressing step at a high pressure, it is preferred that, at least the second pressing step is very sudden to obtain a better compactedness of the pressed material.

The known hydraulic system used to furnish the two different operating pressures are provided with two separate pumps, a first pump for supplying the low pressure, and a second one for supplying the high pressure. These known systems, at least regarding the high pressure, have the disadvantage that the installation of more than a pump with all the required conduits and fixtures is expensive, provides a greater encumbrance of the quipment and a limitation in the sudden transmission of the high pressure and the high pressure pump in particular operates with a non-linear pressure diagram, so that a remarkable loss in power takes place.

SUMMARY OF THE INVENTION

This invention relates as aforesaid to a hydraulic system for supplying hydraulic fluid to a hydraulically operated device alternately at pressures of different value.

An object of the invention is to provide a hydraulic system in which overheating of the liquid is avoided.

Another object of the invention is to provide a hydraulic system which produces a linear operating diagram of the pump.

According to the present invention there is provided a hydraulic system for supplying hydraulic fluid to a hydraulically operated device alternately at pressures of different values, comprising a first hydraulic circuit arranged to be supplied with hydraulic fluid at a low pressure by a pump and for supplying the hydraulic device with fluid at a low pressure through a first pilot operated valve, a second hydraulic circuit provided with a pressure multiplier piston device for producing hydraulic fluid at a pressure greater than that of the low pressure fluid and having a first chamber connected to the first hydraulic circuit and a second chamber of smaller area than the first chamber connected to the second hydraulic circuit, the second hydraulic circuit being provided with a pressure accumulator for maintaining high pressure in the second hydraulic circuit and said second hydraulic circuit being provided with a second pilot operated valve for supplying the hydraulic device with fluid at said high pressure.

The equipment of the invention is characterized in that it is provided with a low pressure hydraulic circuit directly feeding the hydraulic device or utilizer, and a high pressure hydraulic circuit, the device for generating the high pressure liquid being a pressure multiplier device fed by the low pressure hydraulic circuit, said pressure multiplier operating in combination with a high pressure accumulator, so as to maintain constantly the high pressure in the circuit, ready for feeding instantaneously the hydraulic device to be fed, as soon as the communication toward said hydraulic device is opened.

BRIEF DESCRIPTION OF THE DRAWING

To the accomplishment of the foregoing and related ends, the invention then comprises the features hereafter fully described and particularly pointed out in the claims, the following description and annexed drawing setting forth in detail a certain illustrative embodiment of the invention, this being indicative however of only one way in which the principle of the invention may be employed.

In said annexed drawing the single FIGURE is a circuit diagram of a hydraulic system for feeding the operating hydraulic cylinder of a hydraulic press for producing ceramic or refractory tiles.

DESCRIPTION OF THE PREFERRED EMBODIMENT

Referring to said single FIGURE, reference 1 denotes an oil reservoir to which is connected the suction line of a pump P driven by an electric motor M. The output of the pump P passes through a one-way valve 3 and is controlled by an over-pressure safety valve 4. The output is fed continuously to a pressure accumulator 5 through a valve 6, the pressure in the accumulator 5 being controlled by means of a safety valve 7 and a cock 8 that may be opened toward the exhaust.

The output of the pump P is controlled by a minimum and maximum pressure switch 9 and is supplied to a hydraulic device 10, i.e. a hydarulic cylinder, through a pilot operated check valve 11, an adjustable throttle valve 12 and a check valve 13.

The pressure switch 9 acts on a solenoid valve 9' which controls a return flow line. After the solenoid valve 9' has been operated to close the return line the pressure accumulator 5 is supplied with pressure liquid and the hydraulic circuit is filled until an overpressure takes place. The solenoid valve 9' in its other state, i.e. when the return line is open, exhausts all of the flow of the pump P avoiding passing the oil through the safety valve 4 and so avoiding laminar flow and the heating of the oil.

When the pressure is decreased to a permitted minimum value, the pressure switch 9 de-energizes the solenoid valve 9' eliminating the communication to the exhaust and allowing the re-establishment of the pressure in the circuit.

The pilot operated check valve 11 together with a pilot operated check valve 14, that will be discussed hereinbelow, is controlled by a three-position solenoid valve 15 that, when it is set in the intermediate position as in the drawing, does not give any influence to the pilot operated check valves 11 and 14.

When the control valve member of the three-position solenoid operated valve 15 is displaced to the right, as viewed in the drawing, it allows the pressure liquid to flow to the pilot operated check valve 11, and connects the pilot operated check valve 14 to exhaust, and the valve 11 allows the output of the pump P to flow toward the hydraulic device 10. When the solenoid valve 15 is displaced to the left, as viewed in the drawing, it allows the pressure liquid to flow to the pilot operated check valve 14, opening the same, while the pilot operated check valve 11 is connected to the exhaust.

In this manner the output of the pump P feeds the lower pressure or relatively low pressure, to the hydraulic device 10, every time this is needed in an operative cycle.

From the output of the pump P a conduit 16 is provided that, through a solenoid operated valve 17, feeds the chamber of greater operative area of a pressure multiplier 18. The chamber of smaller operative area of the multiplier 18, owing to the fact that it receives from the piston of the device 18 the force generated from the liquid pressure present in the chamber of greater operative area, counteracts said pressure, generating a high pressure that is utilized for feeding the high pressure part of the hydraulic circuit.

Said high pressure part of the hydraulic circuit comprises a conduit 19 to which is connected a conduit 20 leading from the smaller area chamber of the pressure multiplier 18. To one side of the connection point of the conduit 20 with the conduit 19 the conduit 19 is connected to the output of the pump P through a one-way valve 20' that prevents the flow of the oil from the smaller area chamber of device 18 toward the lower pressure part of the hydraulic circuit.

To the other side of the connection point of the conduit 20 with the conduit 19, the conduit 19 is connected to the hydraulic device 10, through a one-way valve 21 and the pilot operated check valve 14.

Upstream of the pilot operated check valve 14, the conduit 19 is connected to a conduit for feeding a pressure accumulator 22 controlled by cocks 23 and 24 and a safety valve 25.

The one-way valve 21 avoids the return of the oil from the pressure accumulator 22 toward the smaller area chamber of the pressure multiplier 18.

The output of the pump P and the conduit 19 are connected to the hydraulic device 10 through a common conduit 27.

A pilot operated check valve 26, controlled by a solenoid valve 28, is able to communicate to exhaust said hydraulic device 10.

When, at the beginning of the operation, the pump P is started, the latter feeds oil under the lower pressure in both the circuits, i.e. the oil fills the output circuit of the pump and the conduit 19 through the one-way valves 20' and 21.

During this initial step, the oil from the conduit 19 enters the smaller area chamber of the pressure amplifier 18 through the conduit 20 filling completely said smaller area chamber and displacing the piston, so as to reduce to a minimum the volume of the greater area chamber of device 18.

Moreover all the conduits of the high pressure hydraulic circuit are filled up to the pilot operated check valve 14, except for the high pressure accumulator 22 that may not be loaded by the low pressure.

At this point, that may correspond to the initiation of the initial step of the operation or to the interval between an ended pressing cycle and the successive one, said interval being employed as an example for extracting the pressed tiles and for charging the moulds with other material, in the case of a press for producing ceramic or refractory tiles, the solenoid valve 17 is energized which allows the feeding of the greater area chamber of the pressure multiplier 18 with low pressure liquid, biassing the piston and displacing the same toward the smaller area chamber, so that the high pressure is generated in the latter chamber and is transmitted through the conduit 19 so that the high pressure accumulator 22 may be loaded.

This step of the operation is important, because the pump P operates in the intervals wherein it would operate only for sending to exhaust a large portion of the oil, through the safety valve 4, with the disadvantages of heating of the oil and consequently with a loss in thermic power, with consequent greater consumption of cooling water or fluid.

In this manner, the high pressure hydraulic circuit is ready for a sudden operation with appreciable reduction of down times and assuring a more linear operation of the pump without intermittences.

At this point, the solenoid valve 17, being already energized, solenoid valve 15 is also energized, so as to displace its valve to the right.

Consequently the pilot operated check valve 11 is opened allowing the feeding of the hydraulic device 10 and executing the operation of this device at the low pressure, i.e. to the pressure of the output of the pump P.

At the end of this operating step, the pilot operated check valve 11 is closed by de-energizing the solenoid three-position valve 15, displacing the valve member of same to the resting or intermediate position and, after an interval of time, more or less short, according to the particular operating cycle, the valve 15 is energized so that the valve member of the solenoid three-position valve 15 is displaced to the left, so that the pilot operated check valve 14 is opened, while the pilot operated check valve 11 is communicated to exhaust.

The opened pilot operated check valve 14 allows the high pressure oil to be fed rapidly to the hydraulic device 10 because of the loaded high pressure accumulator 22 since valve 24 is also opened at this time.

At the end of the operating step with high pressure liquid, the pilot operated check valve 14 is closed again, by de-energizing the solenoid three-position valve 15 and at the same time the solenoid valve 17 is de-energized, while the conduit 27 and the hydraulic device 10 are communicated to exhaust by energizing the solenoid valve 28 controlling the opening of the pilot operated check valve 26.

At this point the operating cycle is ended and simultaneously the de-energization of the solenoid valve 17 allows again the filling of the smaller area chamber of the pressure multiplier 18 setting the hydraulic equipment again ready for beginning a successive operating cycle.

It should be noted that the conduit 27 is a common line that connects the hydraulic device 10 both to the low and high hydraulic circuit, but it prevents any mutual influence of said circuits by means of the one-way valve 13 and the pilot operated check valve 14, because at rest the latter is maintained closed by the greater pressure existing upstream.

Feeding of the high pressure along the conduit 27 does not influence the output of the pump P, i.e. no return liquid takes place toward the pump P because of the one-way valve 13.

Of course the invention may be embodied in many different ways with respect to the embodiment described above and improvements and variations may be made without departing from the scope of the invention as defined in the appended claims.

I, therefore particularly point out and distinctly claim as my invention:

1. A hydraulic system for supplying hydraulic fluid to a hydraulically operated device alternately at pressures of different values, comprising a first hydraulic circuit arranged to be supplied with hydraulic fluid at a low pressure by a pump and for supplying the hydraulic device with fluid at a low pressure through a first pilot operated valve, a second hydraulic circuit provided with a pressure multiplier piston device for producing hydraulic fluid at a pressure greater than that of the low pressure fluid and having a first chamber connected to the first hydraulic circuit and a second chamber of smaller area than the first chamber connected to the second hydraulic circuit, the second hydraulic circuit being provided with a pressure accumulator for maintaining high pressure in the second hydraulic circuit and said second hydraulic circuit being provided with a second pilot operated valve for supplying the hydraulic device with fluid at said high pressure.

2. A hydraulic system as claimed in claim 1, wherein the second hydraulic circuit is connected to the first hydraulic circuit through a conduit provided with a one-way valve to allow all the conduits of the second hydraulic circuit and the second chamber of the pressure multiplier to be filled with liquid supplied by said pump.

3. A hydraulic system as claimed in claim 1, wherein the first hydraulic circuit and the second hydraulic circuit are alternately connected to a common conduit for supplying hydraulic fluid to a said device, one-way valves being provided to prevent flow of hydraulic fluid from one circuit to the other through said common conduit.

4. A hydraulic system as claimed in claim 1, wherein the first hydraulic circuit and the second hydraulic circuit are alternately connected to a common conduit for supplying hydraulic fluid to a said device, one-way valves being provided to prevent flow of hydraulic fluid from one circuit to the other through said common conduit, and said common conduit is connectable to exhaust through a third pilot operated valve to enable the pressure fluid in said common conduit to flow to exhaust.

5. A hydraulic system as claimed in claim 1, wherein the pilot operated valves are controlled so that the filling of the second chamber of the pressure multiplier device and the successive placing of the second hydraulic circuit at the higher pressure takes place in the interval between two successive operating cycles of the hydraulic device to prevent the generation of high pressure during the operating cycle of the device and to produce a more linear operating diagram of the pump.

* * * * *